US005489910A

United States Patent [19]

Kuwata et al.

[11] Patent Number: 5,489,910

[45] Date of Patent: Feb. 6, 1996

[54] IMAGE DISPLAY DEVICE AND METHOD OF DRIVING THE SAME

[75] Inventors: Takeshi Kuwata; Kohji Ikawa; Tatsushi Asakawa; Hiroshi Hasebe; Akira Nakazawa; Hideyuki Nagano; Takanori Ohnishi, all of Yokohama, Japan

[73] Assignee: Asahi Glass Company Ltd., Tokyo, Japan

[21] Appl. No.: 314,435

[22] Filed: Sep. 28, 1994

Related U.S. Application Data

[63] Continuation of Ser. No. 973,950, Nov. 9, 1992, abandoned.

[30] Foreign Application Priority Data

| | | | |
|---|---|---|---|
| Nov. 15, 1991 | [JP] | Japan | 3-327140 |
| Dec. 27, 1991 | [JP] | Japan | 3-359374 |
| Dec. 27, 1991 | [JP] | Japan | 3-359375 |
| Dec. 27, 1991 | [JP] | Japan | 3-359381 |

[51] Int. Cl.[6] ..... G09G 3/36

[52] U.S. Cl. ..... 345/212; 345/96

[58] Field of Search ..... 345/48, 52, 54, 345/55, 58, 78, 79, 96, 101, 204, 211, 212; 330/107, 149, 252, 259, 260, 294; 358/157, 167

[56] References Cited

U.S. PATENT DOCUMENTS

| | | | |
|---|---|---|---|
| 4,485,380 | 11/1984 | Soneda et al. | 348/58 |
| 4,539,527 | 9/1985 | Ishigaki et al. | 330/149 |
| 4,577,161 | 3/1986 | Hirohashi et al. | 330/149 |
| 4,814,722 | 3/1989 | Hartmann et al. | 330/149 |
| 4,999,584 | 3/1991 | Eskelinen | 330/107 |
| 5,087,890 | 2/1992 | Ishiguro et al. | 330/259 |

*Primary Examiner*—Jeffery Brier

*Attorney, Agent, or Firm*—Oblon, Spivak, McClelland, Maier & Neustadt

[57] ABSTRACT

An image display device having an electro-optical medium interposed between a pair of electrode substrates composing a matrix electrode, a driving circuit for driving the electro-optical medium by selectively applying a voltage on the matrix electrode and a reference voltage generator for supplying the driving circuit with a predetermined driving voltage. A noise compensating circuit is interposed between the driving circuit and the reference voltage generator, the noise compensating circuit detecting a noise in a voltage supplied from the reference voltage generator to the electro-optical medium at a predetermined noise detecting position, forming a noise compensating voltage having a first polarity reverse to a second polarity of the noise by using the noise, and supplying the noise compensating voltage to the driving circuit.

8 Claims, 10 Drawing Sheets

FIGURE 1
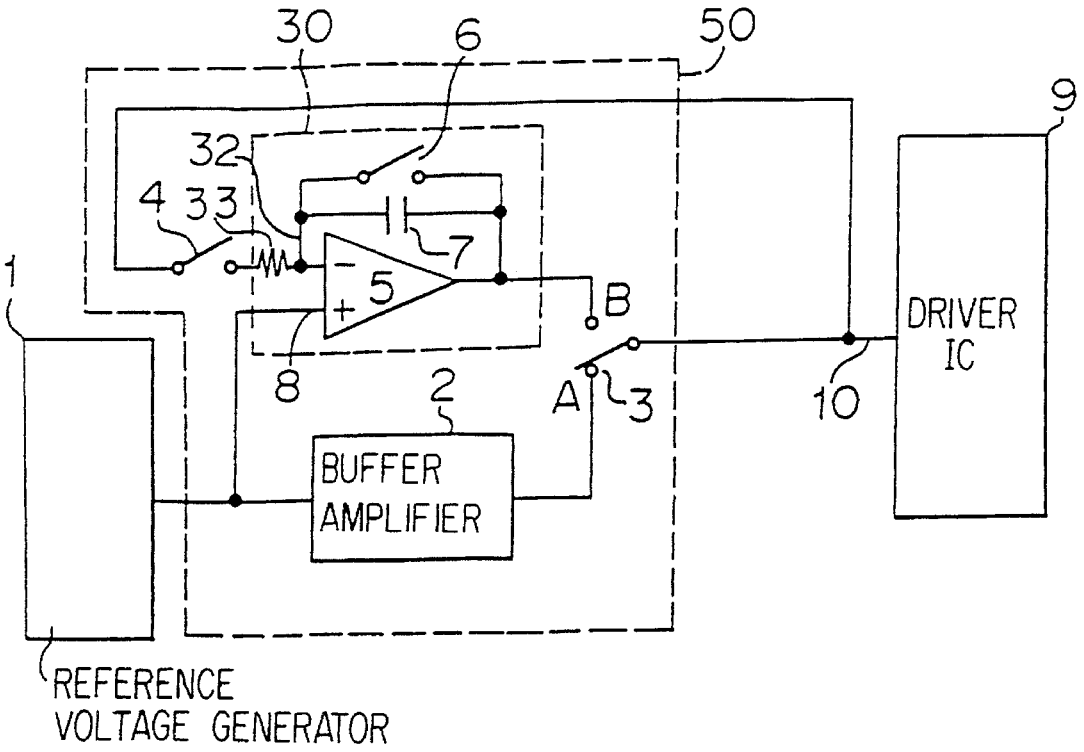
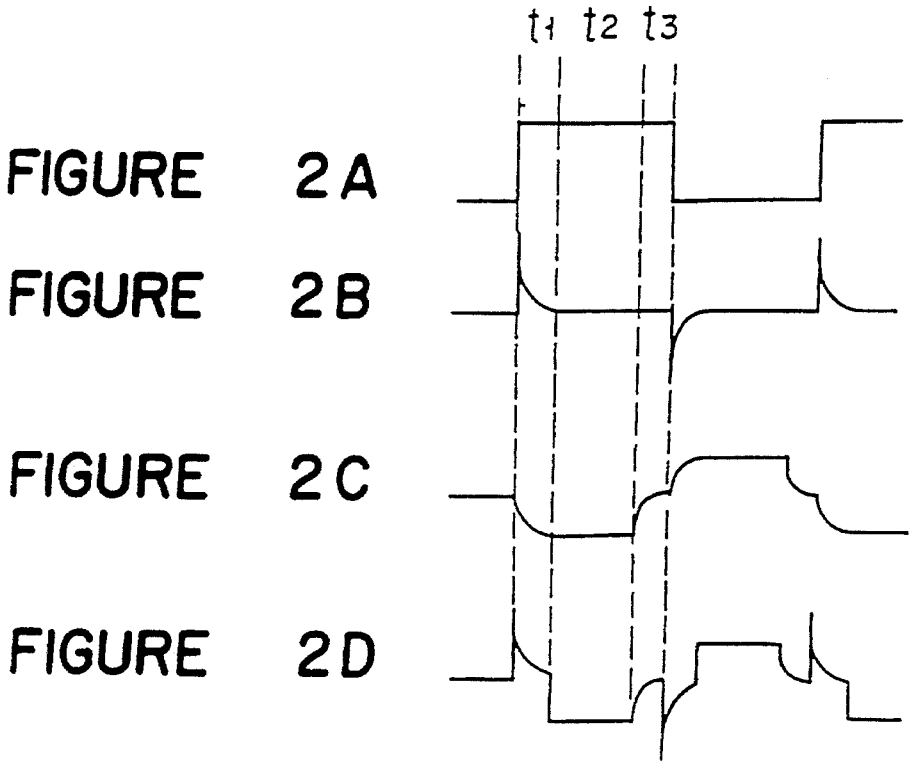

FIGURE 5
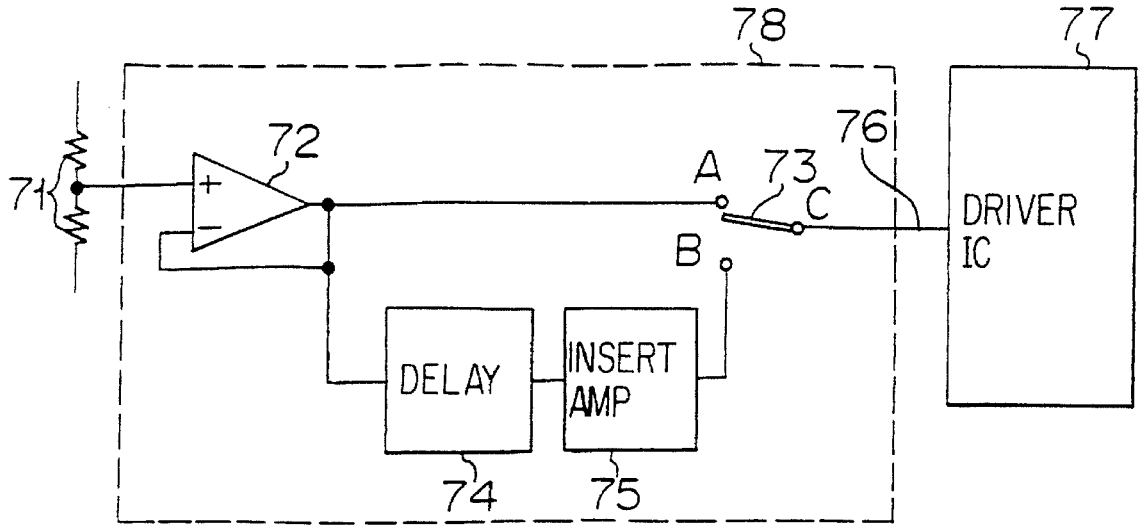
FIGURE 6 A
FIGURE 6 B
FIGURE 6 C
FIGURE 6 D
FIGURE 6 E
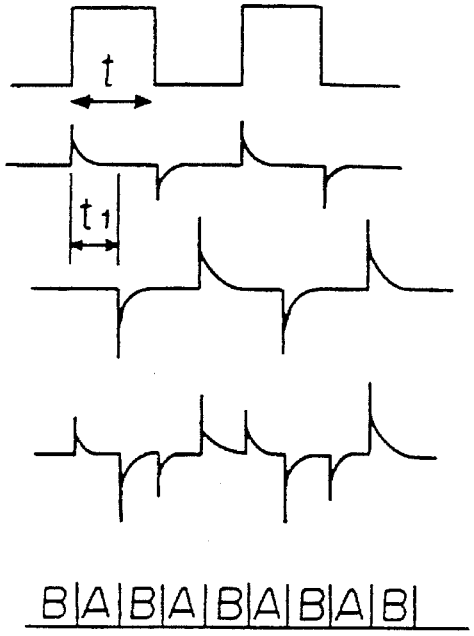

FIGURE 7
PRIOR ART
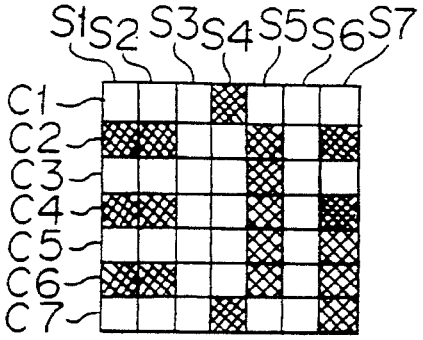
FIGURE 8A
PRIOR ART
FIGURE 8B
PRIOR ART
FIGURE 8C
PRIOR ART
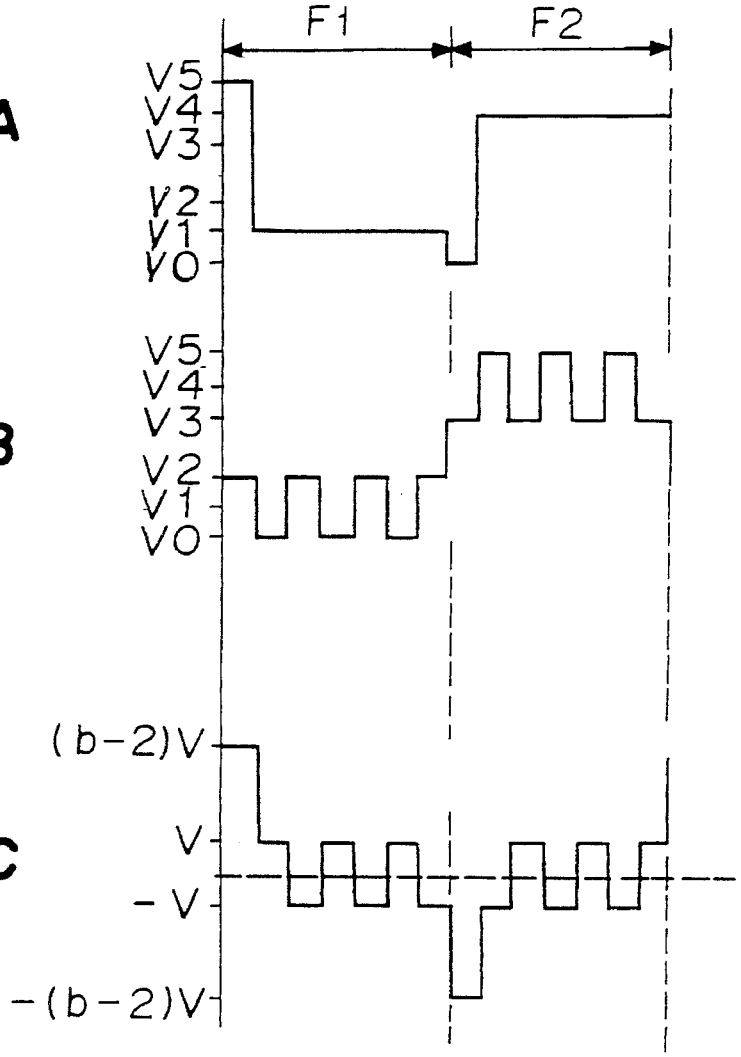

IMAGE DISPLAY DEVICE AND METHOD OF DRIVING THE SAME

This application is a Continuation of application Ser. No. 07/973,950, filed on Nov. 9, 1992, now abandoned.

BACKGROUND OF THE INVENTION

The present invention relates to an image display device and a method of driving the same, particularly to a matrix-type liquid crystal display device performing a multiplex driving.

In an image display device represented by liquid crystal display elements, when the number of segments or the number of pixels is large, a multiplex driving of a time division driving system employing a matrix electrode, is performed. In the structure of the matrix electrode, a pair of electrode substrates are opposingly arranged, a plurality of strip-like row electrodes (X-electrode) are parallely arranged on a first substrate, a plurality of strip-like column electrodes (Y-electrode) are parallely arranged on an opposing second substrate, which are orthogonal to the row electrodes, and a liquid crystal is enclosed and interposed between the both electrode substrates.

In the multiplex driving in such a matrix-type liquid crystal display device, a signal of a row electrode waveform composed of a selecting voltage and a non-selecting voltage is applied on the row electrode in a predetermined frame period, in synchronism therewith, a signal of a column electrode waveform composed of an ON-voltage and an OFF-voltage is supplied on the column electrode and a successive line scanning is performed, thereby performing the display by exciting voltages at liquid crystals at desired matrix intersection point positions (pixel position).

As a method of driving a simple matrix-type liquid crystal display device, a method is known wherein voltages at selected points and unselected points on the matrix, are averaged thereby reducing an influence of the "cross effect" as little as possible. The driving waveforms are shown in FIGS. 8A through 8C and FIGS. 9A through 9C. FIG. 7 shows a display state of a liquid crystal panel to be displayed by these driving waveforms. In FIG. 7, a liquid crystal panel having a 7×7 dots construction, is shown. However, the number of dots in an actual liquid crystal panel is far more larger than that in FIG. 7. The display dot in a hatched portion indicates an ON-state (switch on state), whereas the display dot at a white portion, an OFF-state (switch off state).

In the respective row electrodes C1 through C7, only a single row electrode is selected by successively applying the selecting voltage, and the non-selecting voltage is applied thereon in an unselected time. Furthermore, simultaneously, the ON-voltage or the OFF-voltage is applied on the respective column electrodes S1 through S7. That is to say, when a dot at an intersection point of a certain row electrode and a certain column electrode, is to be switched on, the ON-voltage is applied on the column electrode when the row electrode is in a selected state, whereas, when it is not to be switched on, the OFF-voltage is applied thereon when the row electrode is in a selected state.

Examples of actual driving waveforms are shown in FIGS. 8A through 8C and FIGS. 9A through 9C. FIG. 8A shows a driving waveform applied on the row electrode C1, FIG. 8B, a driving waveform applied on the column electrode S2, and FIG. 8C, a driving waveform applied on a dot at the intersection point of the row electrode C1 and the column electrode S2. FIG. 9A shows a driving waveform applied on the row electrode C2, FIG. 9B, a driving waveform applied on the column electrode S5, and FIG. 9C, a driving waveform applied on a dot at the intersection point of the row electrode C2 and the column electrode S5.

In FIGS. 8A through 8C and 9A through 9C, F1 and F2 designate frame periods. During the frame period F1, V5 designates a selecting voltage, V1, a non-selecting voltage, V0, an ON-voltage and V2, an OFF-voltage. During the frame period F2, V0 designates a selecting voltage, V4, a non-selecting voltage, V5, an ON-voltage and V3, an OFF-voltage. In these Figures, V5–V4=V4–V3=V2–V1=V1–V0=V and V5–V0=bV where b is a bias value. In this way, an alternating current driving is performed by changing the polarity of signal during the frame periods of F1 and F2.

As is known by the comparison between FIGS. 8A through 8C and FIGS. 9A through 9C, whether the dot to be displayed is in the ON-state or in the OFF-state, is determined by whether the ON-voltage is applied on the column electrode or the OFF-voltage is applied thereon, when the row electrode including the dot to be displayed is applied with the selecting voltage.

This driving method is called Optimized Amplitude Selective addressing method which has conventionally been performed.

FIGS. 10A and 10B shows a conventional example of a method of supplying the respective voltages of V0, V1, V2, V3, V4 and V5. Among these, V0 and V5 are supplied by a power supply source or an emitter follower employing a transistor. Furthermore, when a display capacity of the liquid crystal is comparatively small, as shown in an example of FIG. 10A, they are directly supplied to driver ICs from divided resistors. When the display capacity thereof is comparatively large, as shown in an example of FIG. 10B, they are inputted to predetermined terminals of the respective driver ICs whereby impedances thereof are lowered by inserting voltage followers employing operational amplifiers after the divided resistors.

The driver IC is a driving means having a function whereby a row electrode waveform composed of a selecting voltage and a non-selecting voltage, is applied on a row electrode of a matrix-type display device, and a column electrode waveform composed of an ON-voltage and an OFF-voltage, is controlled and applied on a column electrode. In FIGS. 10A and 10B, $V_{adj}$ designates a control voltage which is supplied for controlling the liquid crystal display panel to be provided with a brightness which is easy to see.

However, even in a circuit inserted with the voltage followers after the divided resistors as shown in FIG. 10B, the voltages V1 through V4 are not stable since they are superposed with various noises. Accordingly, there is a variation among root mean square voltages applied on the respective display dots, and a nonuniformity of display is caused.

It is an object of the present invention to provide an image display device having a uniform, with a small nonuniformity of display and easy-to-see image face, wherein a voltage distortion in a spike-like form is reduced by an effective feedback circuit.

SUMMARY OF THE INVENTION

According to a first aspect of the present invention, there is provided an image display device having an electro-optical medium interposed between a pair of electrode substrates composing a matrix electrode, a driving means for driving said electro-optical medium by selectively applying a voltage on said matrix electrode and a reference voltage generator for supplying said driving means with a predetermined driving voltage, characterized by that a noise compensating means is interposed between the driving means and said reference voltage generator, said noise compensating means detecting a noise in a voltage supplied from the reference voltage generator to the electro-optical medium at a predetermined noise detecting position, forming a noise compensating voltage having a first polarity reverse to a second polarity of said noise by using the noise, and supplying said noise compensating voltage to the driving means.

According to a second aspect of the present invention, there is provided the image display device according to the first aspect, wherein the noise detecting position is at an input portion of the driving means for supplying the voltage.

According to a third aspect of the present invention, there is provided the image display device according to the first aspect, wherein a dummy electrode is provided on the electrode substrate and the noise detecting position is provided at said dummy electrode.

According to a fourth aspect of the present invention, there is provided the image display device according to the first aspect, wherein the noise compensating means is provided with an integrator, a change-over switch and an ON-OFF switch, an output terminal of said change-over switch being connected to an input terminal of the driving means, a first one A of input terminals of the change-over switch being connected to an output terminal of the reference voltage generator, a second one B of the input terminals of the change-over switch being connected to an output terminal of the integrator, a first input terminal of the integrator being connected to the predetermined noise detecting position through the ON-OFF switch, a second input terminal of the integrator being supplied with the reference voltage generated by the reference voltage generator as an offset voltage.

According to a fifth aspect of the present invention, there is provided the image display device according to the first aspect, wherein the driving means is supplied with an output of the reference voltage generator and a noise compensating voltage which is obtained by amplifying a difference between an input voltage at an input terminal of the driving means for a supply voltage and the reference voltage and by performing a negative feedback.

According to a sixth aspect of the present invention, there is provided the image display device according to the first aspect, wherein the noise compensating means is composed of a first differential amplifying means and a second differential amplifying means, a positive input terminal of said first differential amplifying means being inputted with an output of the reference voltage generator, an output terminal thereof being connected to an input terminal of the driving means for a supply voltage, a negative input terminal thereof being inputted with an output of said second differential amplifying means whereby a difference between the reference voltage and a voltage at the input terminal of the driving means for the supply voltage is amplified.

According to a seventh aspect of the present invention, there is provided the image display device according to the first aspect, wherein the noise compensating means is composed of a delay means, an inverting amplifier and a change-over switch, an output terminal of said change-over switch being connected to an input terminal of the driving means, a first one A of input switching terminals of said change-over switch being connected to an output terminal of the reference voltage generator, a second one B of the input switching terminals of the change-over switch being connected to the output terminal of the reference voltage generator through said delay means and said inverting amplifier.

In the meantime, the applicant already proposed a method of driving, as a method of driving a liquid crystal display element employing a fast-responsing liquid crystal, wherein the "relaxation phenomena" of a liquid crystal is restrained by simultaneously selecting a plurality of row electrodes, and lowering of the contrast ratio thereof is restrained. (For example, refer to Japanese Patent Application No. 148844/1992.)

This method is basically a method of driving a fast-responsing liquid crystal wherein row electrodes of matrix liquid crystal display elements composed of a plurality of row electrodes and a plurality of column electrodes, are divided into a plurality of row electrode subgroups respectively including a plurality of row electrodes, and the row electrode subgroup is selected as a selecting unit. When a row electrode unit is selected, as a selecting voltage, a voltage which is divided into a plurality of stages and provided with an amplitude of $V_r$ ($V_r>0$) in the positive or the negative direction with respect to an intermediate voltage. Furthermore, when it is not selected, the intermediate voltage is applied thereon as a non-selecting voltage. With respect to a certain row electrode, a time interval from when a voltage corresponding to a stage among the selecting voltages is applied thereon to when a voltage corresponding to the next stage is applied thereon, is selected so that an orientation of liquid crystal molecules generated by the voltage application corresponding to a single stage among the selecting voltages, is substantially maintained until the voltage application corresponding to the next stage.

Specifically, the following driving method is adopted. When J×L (J is an integer of 1 or more and L is an integer of 2 or more) of row electrodes are divided into J of row electrode subgroups respectively composed of L of row electrodes, the selecting voltage is applied in the following sequence.

(1) As selecting voltage matrices, orthogonal matrices A and −A of L row, K column are selected, wherein elements thereof is composed of +1 corresponding to a voltage $+V_r$ or −1 corresponding to a voltage $-V_r$, where K is an integer of $L \leqq K$.

(2) When j-th electrode subgroup is selected, a voltage is applied so that elements of a column vector (hereinafter, selecting voltage vector) of the selecting voltage matrix corresponds with voltage amplitudes in row electrodes composing the J-th row electrode subgroup. This voltage application is performed with respect to all of the selecting voltage vectors.

With respect to the column electrode, in accordance with the display data of the j-th row electrode subgroup (j is an integer of 1 through J) in a specified column, in synchronism with the voltage application to the row electrode, a predetermined one selected from m+1 of voltage levels $V_0$, $V_1$, . . . , $V_m$ (m is an integer).

The image device of this invention is applicable to the image display device wherein such a driving method is adopted, and the effect is considerable. In this case, various levels of voltages are applied on the row electrodes and column electrodes. Noise compensating circuits of this invention are to be connected to outputs of a reference voltage generator corresponding with either one of the levels of the voltages.

BRIEF DESCRIPTION OF THE DRAWINGS

In the drawings:

FIG. 1 is a circuit construction diagram showing an important part of a first embodiment of a liquid crystal display device according to the present invention;

FIGS. 2A through 2D are explanatory diagrams of voltage waveforms driving the liquid crystal display device of FIG. 1;

FIG. 5 is a circuit construction diagram of an important part of a third embodiment of a liquid crystal display device according to the present invention;

FIGS. 6A through 6E are explanatory diagrams of voltage waveforms driving the liquid crystal display device of FIG. 5;

FIG. 7 is a conceptive diagram showing an example of a display content of a liquid crystal panel;

FIGS. 8A through 8C are diagrams showing driving waveforms which are applied on a liquid crystal panel when the display shown in FIG. 7 is performed;

DETAILED DESCRIPTION OF THE DRAWINGS

In this invention, as a specific example of a reference voltage generator for outputting a reference voltage employed in driving a matrix-type display body, with respect to the above-mentioned V0 and V5, they are supplied directly from a power source or by emitter followers in use of transistors, and with respect to V1 through V4, they are supplied from the resistor-dividing of the power source. A noise compensating means is connected to the output side of the reference voltage generator. As the reference voltage, a selecting voltage, a non-selecting voltage, an ON-voltage, an OFF-voltage or the like is pointed out. It is necessary to connect the noise compensating means to an output of at least one of those reference voltages.

Explanation will be given to the operation of this invention concerning the cause of a noise and compensating the noise as follows.

First, explanation will-be given to an example of the cause of a noise, in case of a liquid crystal matrix display element as follows.

A liquid crystal panel is constructed by interposing a dielectric body called a liquid crystal between transference electrodes, which is a capacitative load in view of a driving side thereof. Furthermore, a resistance value of the transference electrodes is not zero and is provided with a limited value. Therefore, even if an ideal waveform is applied thereon from a driver IC, the waveform is considerably distorted inside of the liquid crystal panel, thereby causing a nonuniformity of display. An example of the nonuniformity of the display will be explained by using FIGS. 11A and 11B, FIGS. 12A through 12C, FIGS. 13A through 13C and FIG. 14. In this display, a so-called positive display wherein the more the root mean square voltage applied on a dot, the darker the dot.

Figure 11A:
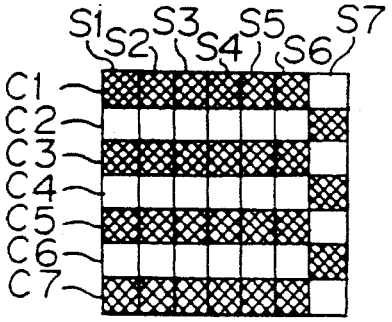
FIG. 11A and 11B are conceptive diagrams showing examples of a display contents of a liquid crystal panel.
Figure 11B:
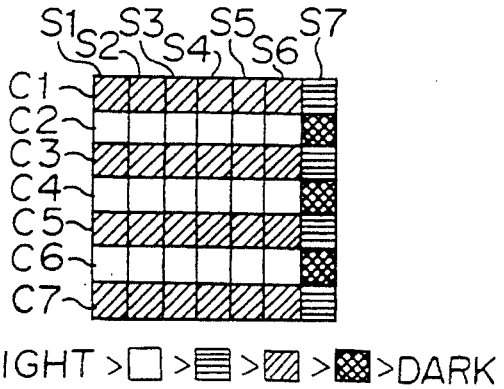
Figure 12A:
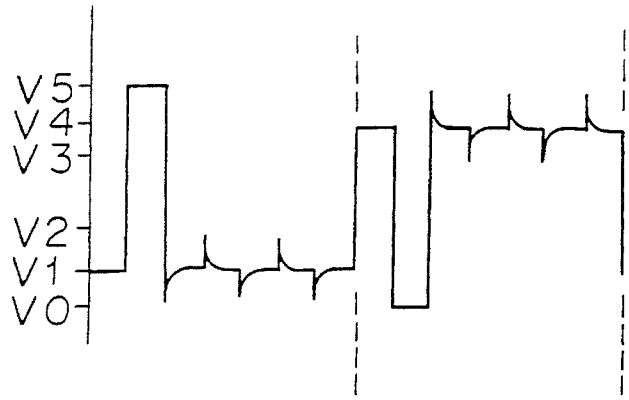
FIGS. 12A through 12C are diagrams of driving waveforms which are actually applied on a liquid crystal panel when the display in FIG. 11B is performed.
Figure 12B:
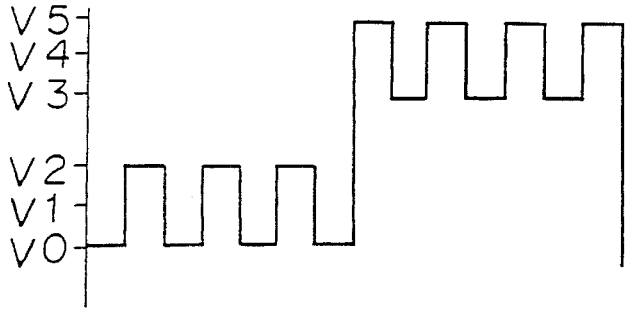

When the display shown in FIG. 11A is to be performed, actually, the nonuniformity of display as in FIG. 11B is generated. The voltage waveform at dot portions of the row electrode C2 in a display area is shown in FIG. 12A, the voltage waveform at the dot portions of the column electrodes S1 through S6, FIG. 12B, and the voltage waveform applied on dots at the intersection points of the row electrode C2 and the column electrodes S1 through S6, FIG. 12C. As shown in FIG. 12A, spike-like voltage distortions are generated at the non-selecting voltage level of the row electrode waveform. Accordingly, as shown in FIG. 12C, distortions of the waveform at non-selecting time, is generated.

Figure 13A:
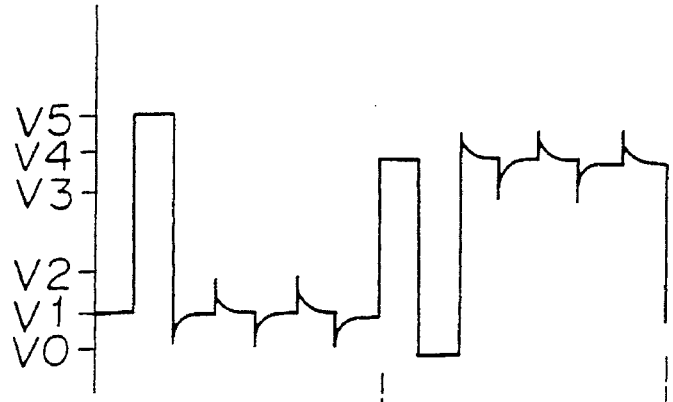
FIGS. 13A through 13C are diagrams of driving waveforms which are actually applied on a liquid crystal panel when the display in FIG. 11B is performed.
Figure 13B:
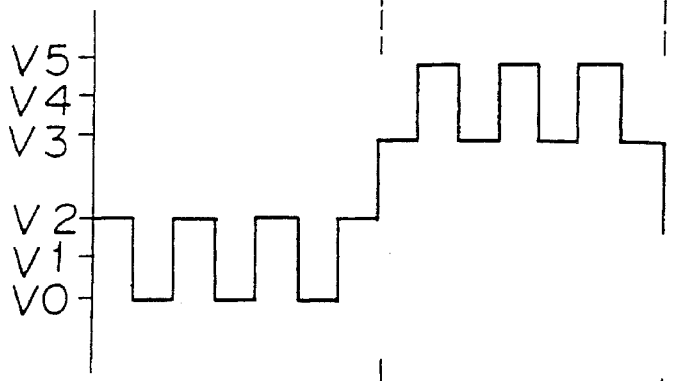
Figure 13C:
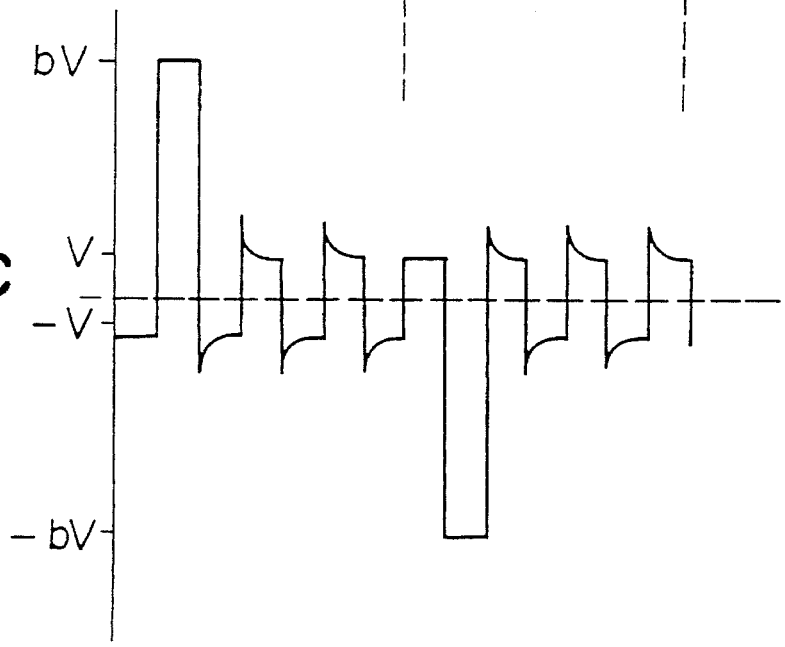

The voltage waveform at the dot portions of the row electrode C2 is shown in FIG. 13A, the voltage waveform at dot portions of the column electrode S7, in FIG. 13B and the waveform applied on a dot at the intersection point of the row electrode C2 and the column electrode S7, in FIG. 13C. As shown in FIG. 13A, spike-like voltage distortions are generated at the non-selecting voltage level of the row electrode waveform. Accordingly, distortions are generated in the waveform at the non-selecting time as shown in FIG. 13C.

Figure 12C:
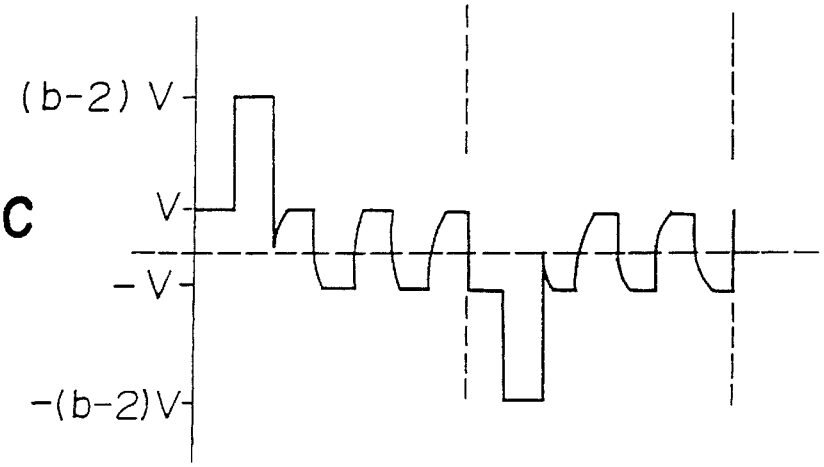

As is simply understood by comparing FIG. 12C with FIG. 13C, in the waveform of FIG. 12C, a root mean square value is smaller than that of an ideal waveform, and in the waveform of FIG. 13C, the root mean square value is larger than that of the ideal waveform. Accordingly, in the actual display, the nonuniformity of display is generated as shown in FIG. 11B.

Figure 14:
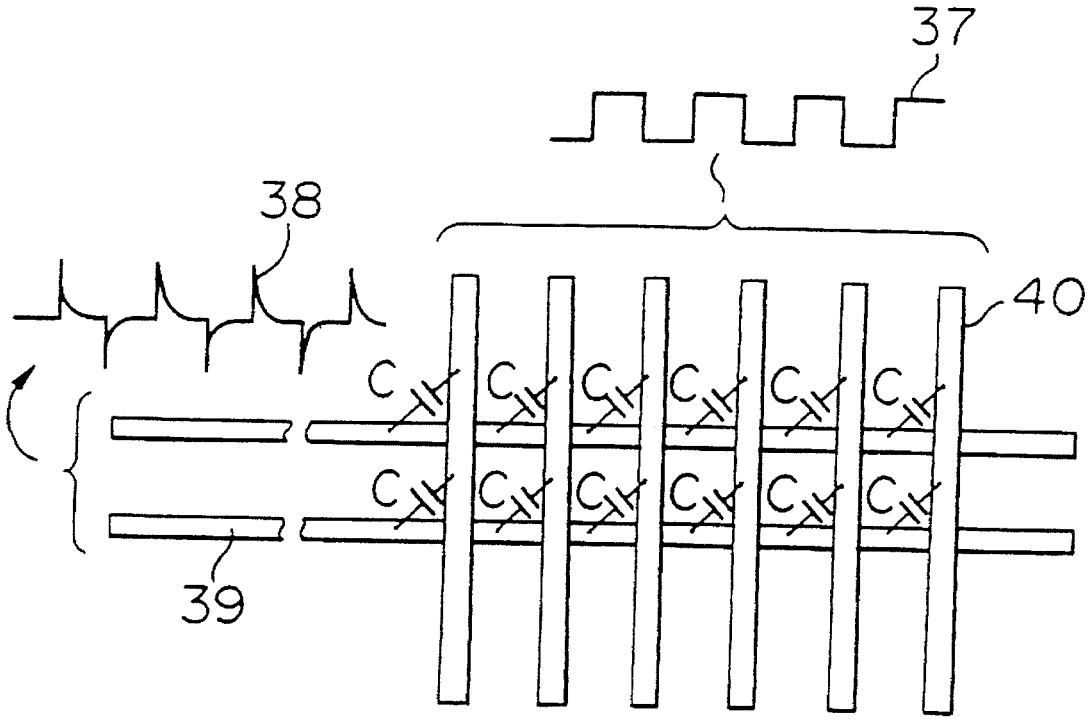
FIG. 14 is a conceptive diagram for explaining a mechanism of generating a spike-like voltage distortion in a non-selecting level of a row electrode waveform.

Explanation will be given to a mechanism wherein the spike-like voltage distortion is generated in the non-selecting voltage level of the row electrode waveform by FIG. 14. When the display shown in FIG. 11A is to be performed, since the column electrode waveform applied to the column electrode 40 is in a rectangular waveform 37 as shown in FIG. 14, this is differentiated by a capacitance C of the liquid crystal and a resistance value R of the row electrode 39, and the waveform 38 is superposed on the non-selecting level of the row voltage waveform. This waveform 38 can be detected at a supply voltage input terminal. However, the amplitude of the detected waveform is attenuated by the influences of the resistance of the electrode and an output impedance of a driver IC, compared with that of a waveform of a voltage actually applied on the liquid crystal. Therefore, the spike-like voltage distortion is generated on the non-selecting voltage level of the row electrode waveform.

This invention can reduce the nonuniformity of display by an original construction wherein a voltage distortion of a driving waveform generated inside of a panel in figures or letters which an image display device displays, is detected by at least one of a selecting voltage supplied to a driver IC, a non-selecting voltage, an ON-voltage and an OFF-voltage, the noise is converted into a noise compensating voltage having a polarity which is reverse to that of the noise, and the noise compensating voltage is applied to the driving means.

EXAMPLE 1

FIG. 1 shows a circuit construction of an important part of a first embodiment of a liquid crystal display device according to the present invention. FIGS. 2A through 2D show time charts of voltage waveforms at respective points when the circuit is operated. FIG. 2A designates a waveform to be applied to a column electrode, FIG. 2B, a voltage distortion generated at an input terminal 10 of a driver IC 9 when a noise compensating means is not employed, FIG. 2C, an output waveform of an integrator 30, and FIG. 2D, an example of a voltage waveform at the non-selecting voltage input terminal 10 when the noise compensating means is employed. In FIGS. 2B through 2D, voltage components deviated from a reference voltage are shown.

In FIG. 1, a reference numeral 50 designates a noise compensating means, 1, a reference voltage generator for generating one of two non-selecting voltages, and 9, a driver IC as a driving means. The driver IC 9 is connected to a matrix electrode for driving a liquid crystal, not shown, which selectively apply a voltage, for instance, on a row electrode.

Explanation will be given in details to the construction of the noise compensating means 50 as follows. The noise compensating means 50 is mainly composed of the integrator 30, a change-over switch 3 and an ON-OFF switch 4.

An output terminal of the change-over switch 3 is connected to an input terminal of a non-selecting voltage 10 of the driver IC 9, a first switching terminal A on the input side thereof is connected to an output terminal of the reference voltage generator 1, and a second switching terminal B at the input side thereof is connected to an output terminal of the integrator 30. As shown in FIG. 1, the switching terminal A of the change-over switch 3 may be connected to the output terminal of the reference voltage generator 1 through a buffer amplifier 2 of an operational amplifier or the like provided as a voltage follower wherein the impedance of the reference voltage is lowered, according to the necessities. By switching the change-over switch 3, the voltage to be supplied to the driver IC 9 may be switched to either one of the output voltage of the integrator 30 and the output voltage of the reference voltage generator 1.

The integrator 30 is composed of an operational amplifier 5, a capacitor 7 and a discharge switch 6 in this example. Therefore, when the discharge switch 6 is opened, the integrator 30 functions, whereas, when the discharged switch 6 is closed, the integrator 30 is discharged and reset.

The input terminal 10 of the driver IC 9 is connected to a negative input terminal 32 of the operational amplifier 5 through the ON-OFF switch 4. Therefore, when the ON-OFF switch 4 is closed while the discharge switch 6 is open, a noise voltage signal of which polarity is inverted, is integrated by the integrator 30. A positive input terminal 8 of the operational amplifier 5 is connected to a predetermined output terminal of the reference voltage generator 1 and is inputted with a reference voltage for controlling an offset voltage.

When the liquid crystal panel is provided with a display pattern shown in FIG. 11A, the column electrode waveform is the one shown in FIG. 2A. At this occasion, a spike-like voltage distortion (noise) as shown in FIG. 2B is generated at the non-selecting voltage input terminal 10 of the driver IC 9.

First, for a time $t_1$ (noise sampling period), while the discharge switch 6 remains open, the change-over switch 3 is switched to A and the ON-OFF switch 4 is closed. At this moment, a spike-like voltage distortion is generated at the non-selecting voltage input terminal 10 of the driver IC 9 as shown in FIG. 2B. A waveform as shown in FIG. 2C is outputted from the integrator 30 and a voltage having an inverted polarity corresponding with the size of the noise is generated.

Next, when the ON-OFF switch 4 is opened and the change-over switch 3 is switched to B for a time $t_2$ (hold period), the output of the integrator 30 is held, a waveform as shown in FIG. 2C is generated at the non-selecting voltage input terminal 10 of the driver IC 9 for the time $t_2$.

This is a voltage for compensating the deviation of the reference voltage due to the spike-like noise shown in FIG. 2B, that is, a voltage corresponding with the noise detected by the input terminal 10 and for compensating the noise. This noise compensating voltage is a voltage having a polarity inverse to that of the spike-like noise. A voltage control is performed while looking at the display, until the nonuniformity of display is extinguished. This voltage can be changed by changing an input resistance 33 provided at the input side of the integrator 30 of which gain may be changed by providing an amplifier thereafter. Furthermore, when there is nonlinearity between the spike-like noise and the compensating voltage, the correction can be performed by providing the amplifier with a corresponding nonlinearity.

Next, for a time $t_3$ (reset period), the discharge switch 6 is closed and the integrator 30 is reset to an initial state thereof. In this occasion, the ON-OFF switch 4 may remain open and the change-over switch 3 may be switched to either one of A and B. The above sequence is summarized in Table 1.

TABLE 1

| | $t_1$ | $t_2$ | $t_3$ |
|---|---|---|---|
| 3 | A | B | A or B |
| 4 | Closed | Open | Open |
| 6 | Open | Open | Closed |

$t_1$: Noise sampling period
$t_2$: Hold period
$t_3$: Reset period
3: Change-over switch
4: ON-OFF swtich
6: Discharge switch FIG. 2D designates a voltage waveform at the non-selecting voltage input terminal 10 when the change-over switch 3 is connected to B during time periods of $t_2$ and $t_3$. In this way, by applying the noise voltage to the driver IC9 by the feedback control, the spike-like noise is removed and the driving voltage which is stabilized on an average is supplied thereto.

When two of the circuits are formed to correct distortions of two non-selecting voltages, they achieve the effect of correction and reduction of the nonuniformity of display is observed. When one of the circuit corresponds to one of the two non-selecting voltages, almost the same effect is achieved.

In a more preferable driving method of this invention, a standby period $t_4$ is provided after the reset period $t_3$, and a sequence composed of the noise sampling period, the hold period, the reset period and the standby period is iterated. In the standby period, the change-over switch 3 is connected to the terminal A. Furthermore, it is preferable that the ON-OFF switch 4 remains open. In this case, the discharge switch 6 may be open or closed.

By providing such a standby period, even when the frame frequency varies according to the kind of the display module, only the value of $t_4$ is changed to cope with it. That is, even when the frame frequency is changed, the noise compensating effect does not vary and a stabilized noise compensating effect can be provided.

Furthermore, a buffer amplifier may be interposed between the noise compensating means and the driving means according to the necessity. In this way, even when the capacity of the liquid crystal varies considerably, the compensating means sufficiently works.

Figure 3:
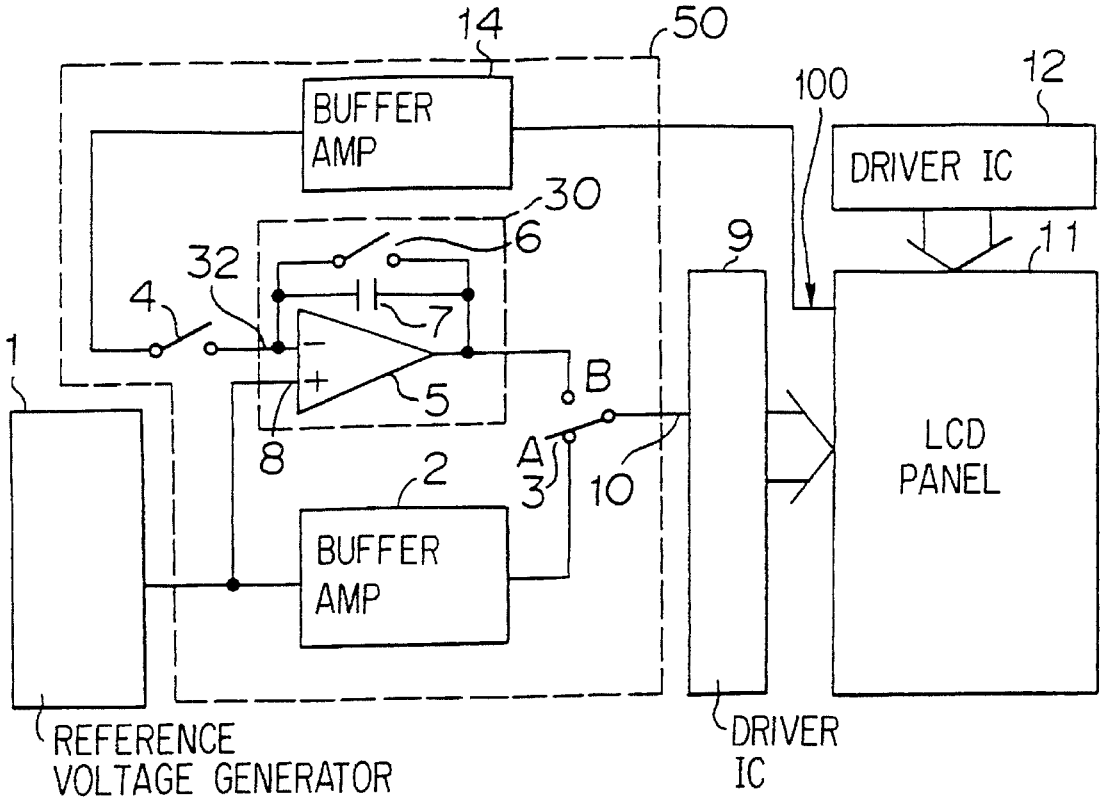
FIG. 3 is a circuit construction diagram of an important part of another example of a liquid crystal display device according to the present invention.

FIG. 3 shows a circuit construction of another embodiment of a liquid crystal display device of this invention employing a similar circuit construction. The output side of the driver IC 9 is connected to terminals of respective row electrodes of a liquid crystal panel 11, whereas the output side of a driver IC 12 for driving column electrodes is connected to terminals of respective column electrodes of the liquid crystal panel 11. The negative input terminal of the operational amplifier 5 in the integrator 30 is connected to a dummy electrode 100 of a liquid crystal panel for detecting the spike-noise through a buffer amplifier 14 and the ON-OFF switch 4.

The circuit of this example differs from the embodiment in FIG. 1 in the detecting method (detecting position) of the spike-like noise and the other construction and operation are the same with those in the embodiment of FIG. 1. Accordingly, the same notation is attached to the same portion with that in FIG. 1 and the explanation of operation is omitted. Furthermore, the buffer amplifier 14 may be omitted.

EXAMPLE 2

Figure 4:
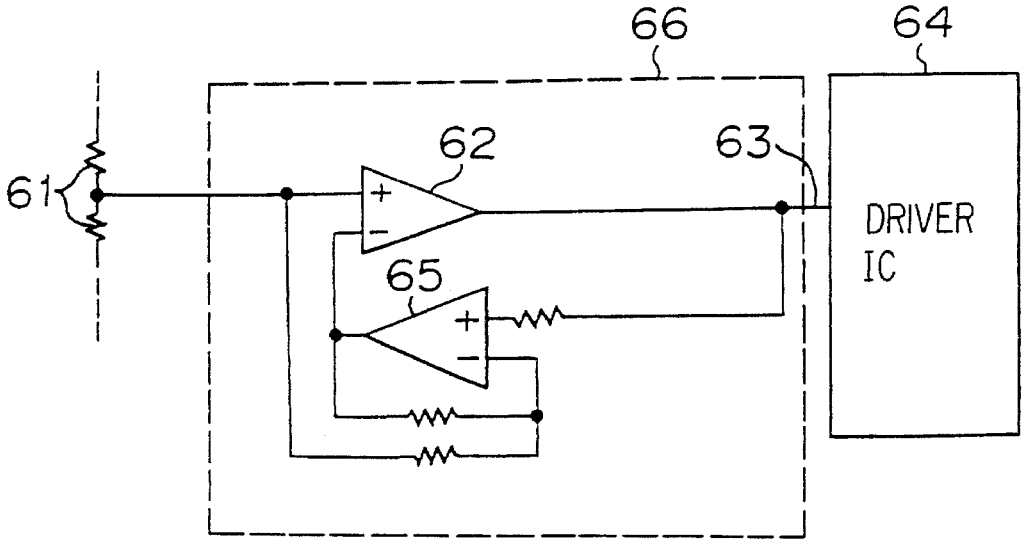
FIG. 4 is a circuit construction diagram of an important part of a second embodiment of a liquid crystal display device according to the present invention.
Figures 9A, 9B, 9C:
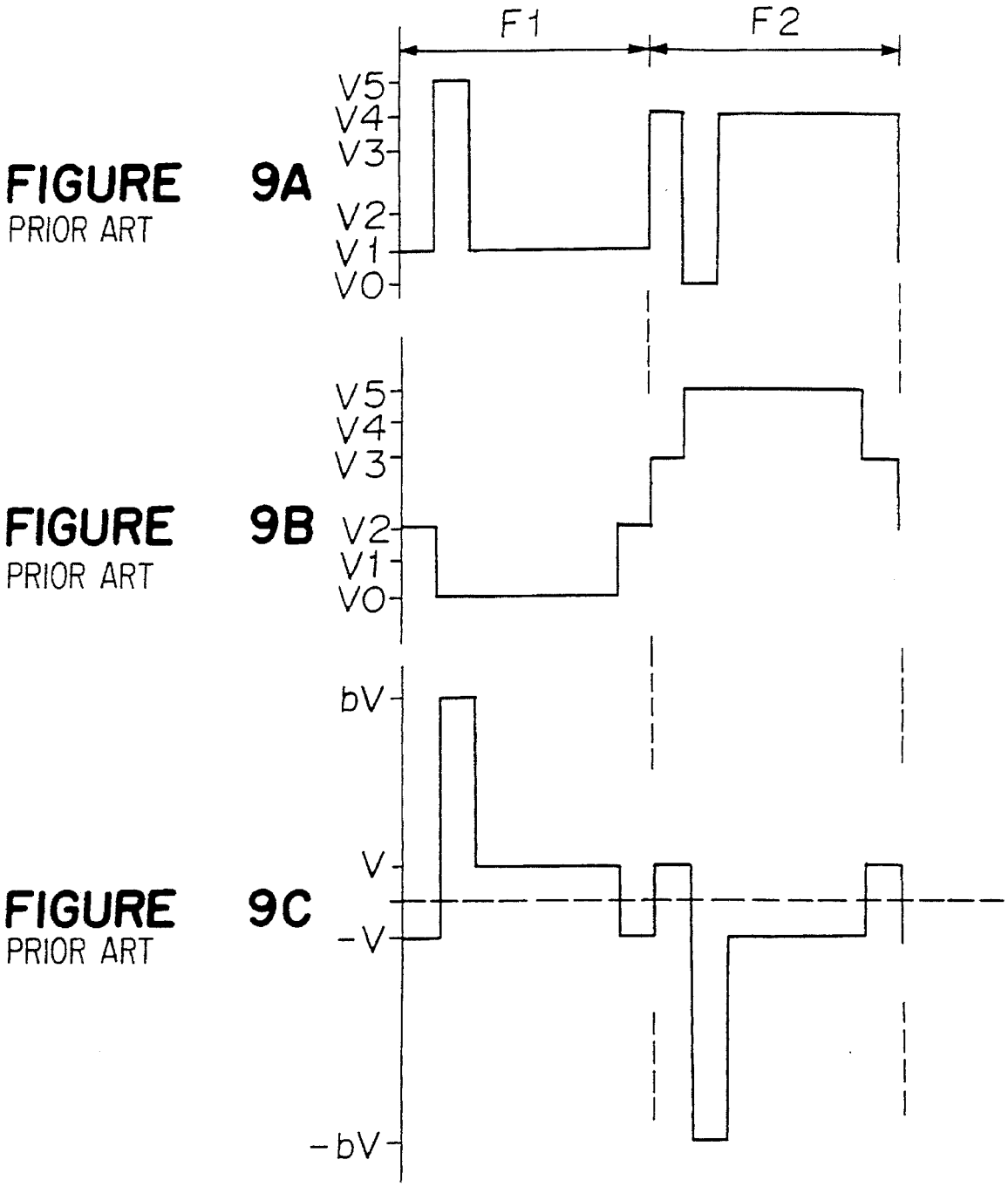
FIGURE 9A PRIOR ART
FIGURE 9B PRIOR ART
FIGURE 9C PRIOR ART
FIGS. 9A through 9C are diagrams of driving waveforms which are applied on the liquid crystal panel when the display shown in FIG. 7 is performed.
Figure 10A:
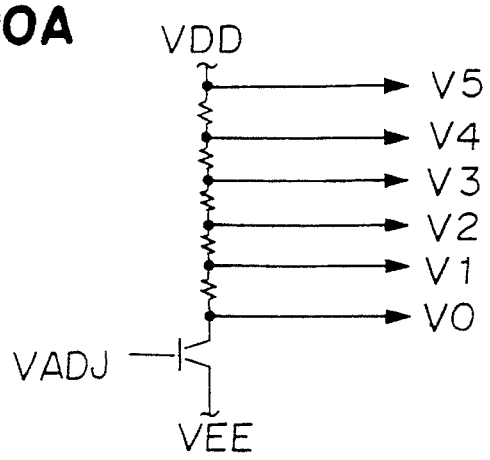
FIGURE 10A PRIOR ART
FIGS. 10A and 10B are circuit diagrams of conventional examples for generating reference voltages supplied to driver ICs.
Figure 10B:
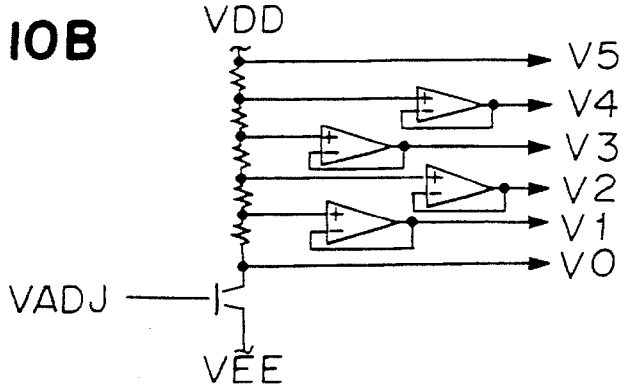
FIGURE 10B PRIOR ART

FIG. 4 shows a second example of a portion of the circuit supplying the reference voltage to the driving means in the image display device of this invention. A reference numeral 61 designates divided resistors for generating one of two non-selecting voltages, which is a reference voltage generator. A numeral 66 designates a noise compensating means in this invention, and 64, a driver IC (driving means). The noise compensating means 66 is interposed between the reference voltage generator 61 and a driver IC 64.

The noise compensating means 66 is composed of a first operational amplifier 62 (differential amplifying means) and a second operational amplifier 65 (differential amplifying means).

The second operational amplifier 65 is employed for amplifying a difference (noise component) between a voltage at an input terminal 63 of a supply voltage of the driver IC 64 and the non-selecting voltage. A positive input terminal thereof is connected to the supply voltage input terminal (noise detecting position in this example) of the driver IC 64 and a negative input terminal thereof is inputted with the non-selecting voltage as an offset voltage, which composes an amplifying circuit of the noise. The gain $\alpha$ of the second operational amplifier is determined to be 3 in this example. However, a range of 2 to 6 is preferable for the gain.

The first operational amplifier 62 is employed for providing the voltage supplied to the driver IC 64 with a low impedance. The positive input terminal thereof is supplied with the non-selecting voltage outputted from the reference voltage generator 61 and the negative input terminal thereof is connected to the output terminal of the second operational amplifier 65. Furthermore, the output terminal thereof is connected to the input terminal for the supply voltage of the driver IC 64. Accordingly, a noise compensating voltage which is formed by amplifying a difference between a voltage at the input terminal 63 for the supply voltage of the driver IC 64 and the non-selecting voltage and by performing a negative feedback, is applied on the driver IC 64 along with the non-selecting voltage outputted from the reference voltage generator 61.

When two of the circuits are formed, which are employed for correcting distortions of two non-selecting voltages, the voltage distortion is reduced to almost zero and reduction of the nonuniformity of display is observed. When one of the circuit is employed for correcting one of the two non-selecting voltages, almost the same effect is obtained. Furthermore, when the circuit is employed for the ON-voltage or the OFF-voltage, a further reduction in the display nonuniformity is performed.

Furthermore, since the liquid crystal is a capacitative load, much current flows therein instantaneously. Therefore, to effectively remove the voltage distortion, the detecting line for performing the negative feedback is preferably to be drawn from a location as near to the load as possible.

In the circuit of this example, the noise detection is performed at the input terminal for the supply voltage of the driving means. However, the noise detection may be performed by providing a dummy electrode for detecting the noise on the substrates interposing the liquid crystal layer.

EXAMPLE 3

FIG. 5 shows the circuit construction of an important part of a third example of a liquid crystal device according to the present invention. FIGS. 6A through 6E show time charts of voltage waveforms when the circuit is operated. In FIG. 5, a reference numeral 78 designates a noise compensating means, 71, divided resistors, which is a reference voltage generator for generating one of two non-selecting voltages, and 77, a driver IC which is a driving means. The driver IC 77 is connected to a matrix electrode for driving a liquid crystal, not shown, which selectively applies voltage on, for instance, row electrodes.

A detailed explanation will be given to the noise compensating means 78 as follows. The noise compensating means 78 is mainly composed of a change-over switch 73, a delay means 74 and an inverting amplifier 75.

An output terminal of the change-over switch 73 is connected to an input terminal 76 for non-selecting voltage of the driver IC 77, a first switching terminal A at the input side thereof is connected to an output terminal of a reference voltage generator 71 and a second switching terminal B at the input side thereof is connected to the output terminal of the reference voltage generator 71 through the delay means 74 and the inverting amplifier 75. The respective switching terminals A and B of the change-over switch 73 may be connected to the output terminal of the reference voltage generator 71 through a buffer amplifier 72 of an operational amplifier or the like provided as a voltage follower that provides the reference voltage with a low impedance, as shown in FIG. 1, according to the necessity. By switching the change-over switch 73, the voltage supplied to the driver IC 77 can be switched either directly to the output voltage of the reference voltage generator 71 or to the output voltage of the reference voltage generator 71 through the delay means 74 and the inverting amplifier 75.

Figure 15:
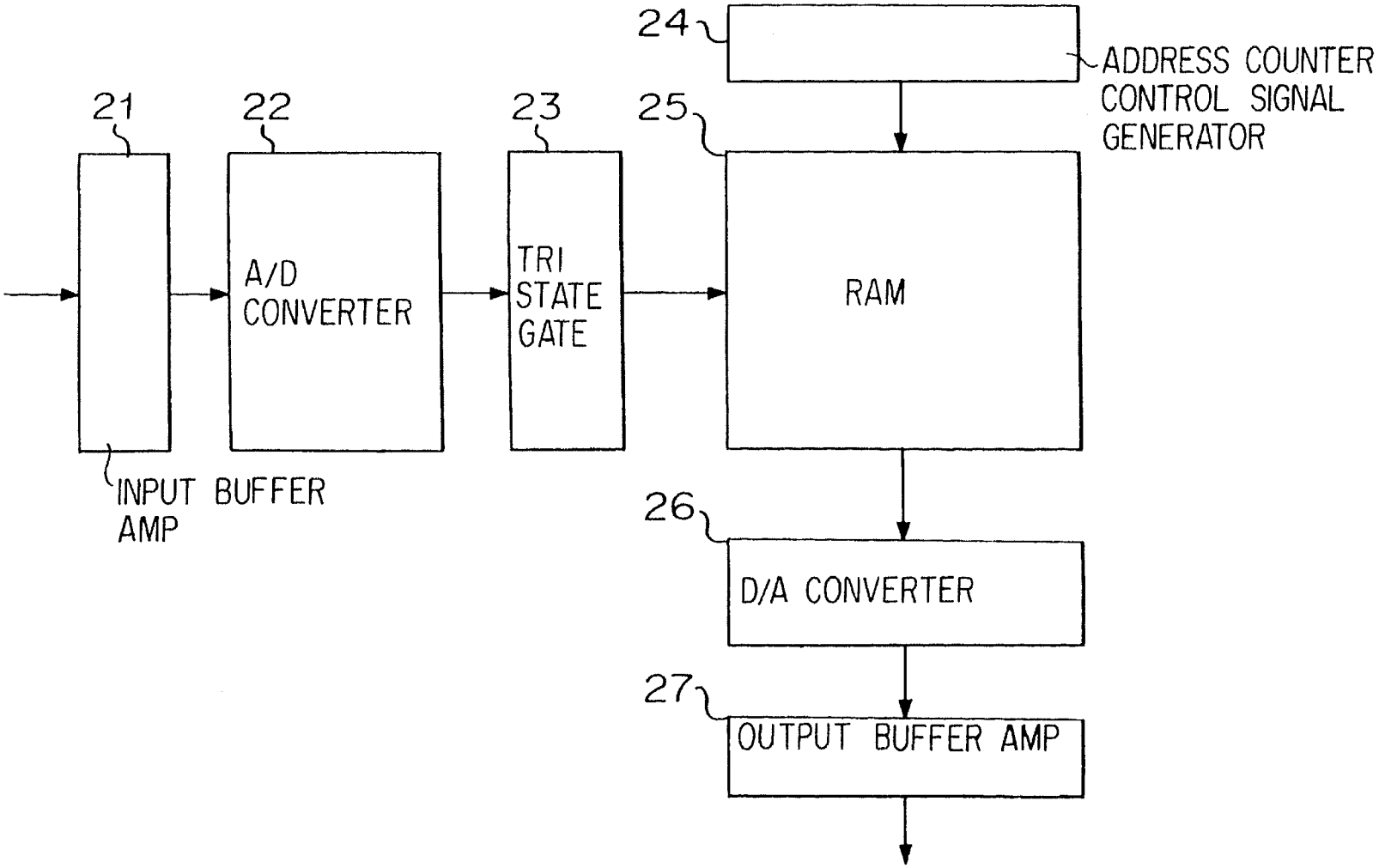
FIG. 15 is a diagram showing a delay means.

The delay means 74 may be of a delay line of analogue system such as a CCD delay line, a glass delay line or the like, or a construction shown in FIG. 15. In FIG. 15, a reference numeral 21 designates an input buffer amplifier, 22, an A/D converter, 23, a tri-state buffer gate, 24, an address counter of a RAM and a control signal generator, 25, a RAM, 26, a D/A converter and 27, an output buffer amplifier. This is a delay line of a digital system wherein A/D-converted data are memorized in a memory, which are read out being delayed for a certain time, and D/A-converted. Furthermore, a differential amplifier may be employed as the inverting amplifier 75. The position of the delay means 74 and the inverting amplifier 75 may be interchanged in the Figure.

Explanation will be given to the operation of the circuit of this Example as follows.

When the liquid crystal panel is in the display pattern as shown in FIGS. 11A, the column electrode waveform is as shown in FIG. 6A. In this occasion, a spike-like voltage distortion (noise) as shown in FIG. 6B is generated at the input terminal 76 for the non-selecting voltage of the driver IC 77.

When the change-over switch 73 of FIG. 5 is connected to the switching terminal A, this voltage distortion is transmitted to-the output of the operational amplifier 72, which is delayed by the delay means 74 by a time t and amplified by the inverting amplifier 75. Accordingly, a voltage at the switching terminal B of the change-over switch 73 is deviated from the reference voltage as shown in FIG. 6C.

Therefore, when a time $t_1$ which is shorter than the time t, has elapsed, by connecting the change-over switch 73 to B, a waveform shown in FIG. 6D is observed at the input terminal 76 of the driver IC77 as a deviation of the reference voltage.

In the operation of the change-over switch 73, as shown in FIG. 6E, the change-over switch 73 is connected to the switching terminal A during the starting time $t_1$ (reference voltage supply period, $t_1 \leqq t$) in a cycle of a single row electrode selecting time, and to the switching terminal B during a residual time (noise correcting period) thereof. In this way, during the reference voltage supply period, the reference voltage outputted from the reference voltage generator superposed with the noise is applied to the input terminal 76 of the driver IC 77, and during the noise correcting period, a voltage wherein the reference voltages superposed with a voltage provided with a phase reverse to that in the reference voltage supply period, is supplied thereto.

As stated above (refer to FIG. 14), the spike-like voltage distortion is attenuated compared with a wave height value thereof inside of the liquid crystal panel when it is detected by the delay means 74. Therefore, an amplification is performed in the amplifier 75 to correct the attenuated value. In this example, the delay means 74 is provided with 6 bits as the bit number in case of a digital system and the sampling frequency is 10 MHz. The delay time t depends on the capacity of the liquid crystal panel. In this example, the delay time is set to be 10 μsec.

When two of the circuits are formed for correcting the distortions of two non-selecting voltages, they are effective in the correction of the voltage distortion and the reduction of the nonuniformity of display is observed. When one of the circuits is employed for one of the two non-selecting voltages, almost the same effect is achieved.

As stated above, the reduction of the nonuniformity of display is made possible in this invention, by canceling the voltage distortion which is superposed on the reference voltage supplied to the driver IC which is the driving means, by the effective feedback circuit. Furthermore, since the circuit construction is simple, the invention is provided with an advantage of realizing the circuit at a low cost.

In this specification, explanation has been given to the present invention with the example of a liquid crystal display device. However, this invention is applicable to various image-display devices such as an electroluminescent display, a plasma display or the like.

We claim:

1. An image display device having an electro-optical medium interposed between a pair of substrates each provided with an electrode, which comprises:

(a) a driving means for driving the electro-optical medium by selectively applying voltages to the electrodes of the pair of substrates;

(b) a reference voltage generator for supplying the driving means with a reference voltage;

(c) an integrator, a first input terminal of which is connected to a sampling position between the reference voltage generator and the electro-optical medium so that the integrator samples a noise superposed voltage superposed with a noise and a second input terminal of which is connected to the reference voltage generator so that the integrator is supplied with the reference voltage as an offset voltage, amplifying inversely and integrating the noise whereby the integrator generates a noise compensating voltage having a polarity which is reverse to a polarity of the noise and a size which is correspondent to a size of the noise; and (d) a change-over switch, a first input terminal of which is connected to an output of the integrator, a second input terminal of which is connected to the reference voltage generator and an output terminal is connected to the driving means, switching an input of the driving means to either of the noise compensating voltage and the noise-superposed voltage.

2. The image display device according to claim 1, which further comprises an ON-OFF switch interposed between the sampling position and the integrator.

3. An image display device having an electro-optical medium interposed between a pair of substrates each provided with an electrode, which comprises:

(a) a driving means for driving the electro-optical medium by selectively applying voltages to the electrodes of the pair of substrates;

(b) a reference voltage generator for supplying the driving means with a reference voltage; and (c) a noise compensating means interposed between the driving means and the reference voltage generator for compensating a noise in a voltage supplied from the reference voltage generator to the electro-optical medium, said noise compensating means comprising;

(c1) means for inversely amplifying the noise in a noise-superposed voltage which is sampled at a sampling position between the reference voltage generator and the electro-optical medium so that a noise compensating voltage having a polarity which is reverse to a polarity of the noise and a size which is correspondent to a size of the noise, is generated;

(c2) holding means for holding the noise compensating voltage during a time period of sampling the noise-superposed voltage; and (c3) switching means, an output of which is connected to the driving means for switching an input of the driving means to either of the noise compensating voltage and the noise-superposed voltage.

4. The image display device according to claim 3, wherein said means for inversely amplifying a noise is an inverting amplifier, said holding means and said switching means comprise a delay circuit element and a change-over switch.

5. The image display device according to claim 3, wherein said means for inversely amplifying a noise, said holding means and said switching means comprise:

(a) an integrator, a first input terminal of which is connected to a sampling position between the reference voltage generator and the electro-optical medium so that the integrator samples a noise-superposed voltage superposed with a noise and a second input terminal of which is connected to the reference voltage generator so that the integrator is supplied with the reference voltage as an offset voltage, amplifying inversely and integrating the noise, whereby the integrator generates a noise compensating voltage; and (b) a change-over switch, a first input terminal of which is connected to an output of the integrator, a second input terminal of which is connected to the reference voltage generator and an output terminal is connected to the driving means, switching an input of the driving means to either of the noise compensating voltage and the noise superposed voltage.

6. The image display device according to claim 5, wherein said noise compensating means further comprises an ON-OFF switch interposed between the sampling position and the integrator.

7. A method of driving an image display device having an electro-optical medium interposed between a pair of electrodes each provided with an electrode, a driving means for driving the electro-optical medium by selectively applying voltages to the electrodes of the pair of substrates and a reference voltage generator for supplying the driving means with a reference voltage, said supplying the driving means with the reference voltage comprising the steps of:

(a) supplying the driving means with a noise-superposed voltage superposed with a noise;

(b) generating a noise compensating voltage, having a polarity which is reverse to a polarity of the noise and a size which is correspondent to a size of the noise, by (b1) sampling the noise-superposed voltage at a sampling position between the reference voltage generator and the electro-optical medium during a time period of supplying the noise-superposed voltage; and (b2) inversely amplifying the noise;

(c) holding the noise compensating voltage during a time period of sampling the noise-superposed voltage; and (d) supplying the noise compensating voltage to the electro-optical medium after the time period of sampling the noise-superposed voltage.

8. The method of driving an image display device according to claim 7, wherein step (b) further comprises:

integrating the noise during a time period of generating the noise compensating voltage.

* * * * *